US008951613B2

(12) United States Patent
Adams et al.

(10) Patent No.: US 8,951,613 B2
(45) Date of Patent: Feb. 10, 2015

(54) METHOD OF COATING A WORKPIECE INCORPORATING A COLOR CONTRIBUTING PRIMER LAYER

(75) Inventors: Scott Adams, Milan, MI (US); Daniel J. McQuaid, South Lyon, MI (US); James Bielak, Canton, MI (US); Aaron Fiala, Newport, MI (US); Majed Hussein Elawar, Ann Arbor, MI (US); Michael Jones, Pleasant Ridge, MI (US)

(73) Assignee: Ford Motor Company, Dearborn, MI (US)

( * ) Notice: Subject to any disclaimer, the term of this patent is extended or adjusted under 35 U.S.C. 154(b) by 726 days.

(21) Appl. No.: 13/095,055

(22) Filed: Apr. 27, 2011

(65) Prior Publication Data

US 2012/0276281 A1 Nov. 1, 2012

(51) Int. Cl.

| | |
|---|---|
| ***B05D 1/36*** | (2006.01) |
| ***B05D 7/00*** | (2006.01) |
| ***B05D 5/06*** | (2006.01) |
| *B05D 7/14* | (2006.01) |

(52) U.S. Cl.

CPC ..... *B05D 5/063* (2013.01); *B05D 7/572* (2013.01); *B05D 7/577* (2013.01); *B05D 7/14* (2013.01); *B05D 5/066* (2013.01); *B05D 2202/00* (2013.01)

USPC ..... 427/402; 427/372.2; 427/407.1; 427/409; 427/470

(58) Field of Classification Search

None

See application file for complete search history.

(56) References Cited

U.S. PATENT DOCUMENTS

| | | | | |
|---|---|---|---|---|
| 4,615,940 | A * | 10/1986 | Panush et al. | 428/324 |
| 6,887,526 | B1 * | 5/2005 | Arlt et al. | 427/407.1 |
| 2004/0175551 | A1 | 9/2004 | Dunlop et al. | |
| 2006/0051513 | A1 * | 3/2006 | Jackson et al. | 427/402 |
| 2008/0107841 | A1 | 5/2008 | Remillard et al. | |
| 2009/0074968 | A1 | 3/2009 | Dunlop et al. | |
| 2009/0104357 | A1 * | 4/2009 | Dattilo | 427/331 |

FOREIGN PATENT DOCUMENTS

| | | | |
|---|---|---|---|
| CN | 1506169 | A | 6/2004 |
| CN | 101376129 | A | 3/2009 |
| JP | H1190317 | A | 4/1999 |

OTHER PUBLICATIONS

Chinese Patent and Trademark Office, Office Action for the corresponding Chinese Patent Application No. 201210111163.8 mailed Aug. 29, 2014.

* cited by examiner

*Primary Examiner* — Timothy Meeks
*Assistant Examiner* — Michael P Rodriguez
(74) *Attorney, Agent, or Firm* — Damian Porcari; Brooks Kushman P.C.

(57) ABSTRACT

A method of coating a workpiece. The method includes applying a primer layer having a color pigment to the workpiece, applying a basecoat layer to the primer layer, and applying a clearcoat layer to the basecoat layer. The primer layer contributes to the color of the workpiece.

11 Claims, 1 Drawing Sheet

METHOD OF COATING A WORKPIECE INCORPORATING A COLOR CONTRIBUTING PRIMER LAYER

TECHNICAL FIELD

The present invention relates to a method of coating a workpiece, such as a vehicle body.

BACKGROUND

A method of painting a vehicle is disclosed in U.S. Pat. No. 6,376,016.

SUMMARY

In at least one embodiment, a method of coating a workpiece is provided. The method may include applying a primer layer having a color pigment to the workpiece, applying a basecoat layer to the primer layer, and applying a clearcoat layer to the basecoat layer. The primer layer is visible through the basecoat layer and the clearcoat layer such that the color pigment contributes to the color of the workpiece.

In at least one embodiment, a method of coating a vehicle body is provided. A color-keyed primer having a color pigment is applied to the vehicle body. A first basecoat layer is applied upon the color-keyed primer layer before the color-keyed primer layer is cured. A first clearcoat layer is applied over the first basecoat layer before the first basecoat layer is cured. The vehicle body is baked to cure the color-keyed primer layer, first basecoat layer, and first clearcoat layer such that the color pigment reflects light through the first basecoat layer and first clearcoat layer after baking.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
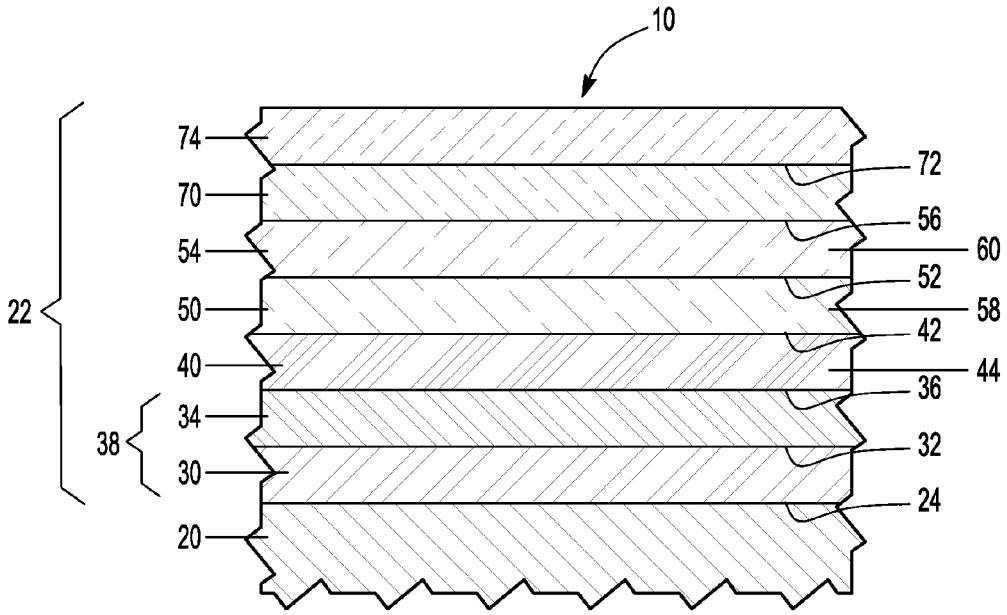
FIG. 1 is an exemplary fragmentary section view of a workpiece having multiple coating layers.

Referring to FIG. 1, an exemplary workpiece 10 is shown. In an automotive or vehicular context, the workpiece 10 may be an exterior vehicle body component or a vehicle body subassembly that may include a visible exterior surface of the vehicle. Exemplary vehicle body components include closures, such as a door, hood, trunk, liftgate, or tailgate, and body structures, such as door frames, fenders, roof panels, side panels, cowls, and the like. Such components may be preassembled into a vehicle body subassembly prior to the application of one or more coating layers.

The workpiece 10 may include a base material or substrate 20 and a plurality of discrete coating layers 22. In at least one embodiment, the substrate 20 may be made of a metal or metal alloy and include an outer surface 24.

The coating layers 22 may be provided on the substrate 20 to protect the substrate 20, protect a previously applied coating layer, facilitate adhesion or bonding of one coating layer to another, and/or provide a desired aesthetic appearance. Embodiments having additional or fewer layers than those shown in FIG. 1 are contemplated. The coating layers 22 may be applied with a generally uniform thickness.

A corrosion resistant layer 30 may be applied to and may be disposed directly on the surface 24 of the substrate 20. As such, the corrosion resistant layer 30 may have a surface 32 disposed opposite the surface 24 of the substrate 20. The corrosion resistant layer 30 may be of any suitable type, such as zinc phosphate, and may be applied in any suitable manner, such as by electrocoating or spraying.

A pretreat primer layer 34 may be applied to and may be disposed directly on a surface of an underlying layer, such as the surface 32 of the corrosion resistant layer 30. As such, the pretreat primer layer 34 may have a surface 36 disposed opposite the surface 32 of the corrosion resistant layer 30. The pretreat primer layer 34, which may be optional in some applications, may be of any suitable type and may facilitate bonding or adhesion of a subsequently applied layer. The corrosion resistant layer 30 and/or pretreat primer layer 34, may be referred to as pretreat layers 38 below.

A color-keyed primer layer 40 may be applied to and may be disposed directly on a surface of an underlying layer, such as the surface 36 of the pretreat primer layer 34. As such, the color-keyed primer layer 40 may have a surface 42 disposed opposite the surface 36 of the pretreat primer layer 34. The color-keyed primer layer 40 may be applied in any suitable matter, such as by electrocoating or spraying.

The color-keyed primer layer 40 may be opaque such that the pretreat layers 38 are not visible through the color-keyed primer layer 40. The color-keyed primer layer 40 may include a color pigment 44 that may be distributed throughout the color-keyed primer layer 40 and may contribute to the color of the workpiece 10. The color-keyed primer layer 40 and color pigment 44 may contribute to the color of the workpiece 10 in various ways. First, the color-keyed primer layer 40 may be visible through subsequently applied layers. For example, the workpiece 10 may appear to be a particular color, such as green, due to a green color pigment in the color-keyed primer layer 40. Second, the color-keyed primer layer 40 may be visible in combination with a color pigment in one or more subsequently applied layers. Such a combination may affect the perceived color of the workpiece 10. In one example, the workpiece 10 may appear to be green due to a combination of different wavelengths of light reflected by a blue color pigment in the color-keyed primer layer 40 and light reflected by a yellow color pigment in one or more coating layers that overlay the color-keyed primer layer 40. In another example, the color-keyed primer layer 40 may have a white color pigment that may appear to increase the brightness of a color pigment in one or more coating layers that overlay the color-keyed primer layer 40. In another example, the color-keyed primer layer 40 may have gray color pigment that may darken or decrease the brightness of a color pigment in one or more overlying coating layers.

One or more basecoat layers may be applied over the color-keyed primer layer 40. In the embodiment shown in FIG. 1, two basecoat layers are illustrated; however, a greater or lesser number of basecoat layers may be provided. The basecoat layers may be applied in any suitable manner, such as by spraying with a robotic manipulator. In addition, a basecoat layer may be applied as a discrete layer such that any color pigment therein does not combine or mix with the color pigment 44 of the color-keyed primer layer 40. One or more basecoat layers may cooperate with the color-keyed primer layer 40 to absorb some wavelengths of light while reflecting others such that color of the reflected surface is a function of the reflected wavelengths of light.

A first basecoat layer 50 may be applied to and may be disposed directly on a surface of an underlying layer, such as the surface 42 of the color-keyed primer layer 40. As such, the first basecoat layer 50 may have a surface 52 disposed opposite the surface 42 of the color-keyed primer layer 40. Similarly, a second basecoat layer 54 may be applied to and may be disposed directly on the surface 52 of the first basecoat layer 50. The second basecoat layer 54 may have a surface 56 disposed opposite the surface 52 of the first basecoat layer 50. The first and second basecoat layers 50, 54 may each be semitransparent or transparent such that the color pigment 44 of the color-keyed primer layer 40 is visible or reflects light through the basecoat layers 50, 54 or contributes to the color of the workpiece as described above. If the first basecoat layer 50 is semitransparent it may allow light to pass through diffusely and may include a color pigment 58. Similarly, if the second basecoat layer 54 is semitransparent, is may allow light to pass diffusely and may include a color pigment 60. The color pigments 58, 60 may be the same or different depending on the desired appearance of the workpiece 10. A transparent basecoat layer may be one that does not include a color pigment or appears to be clear such that light is transmitted without appreciable scattering so that a layer lying underneath is seen clearly.

One or more clearcoat layers may be applied over the basecoat layer(s) 50, 54. In the embodiment shown in FIG. 1, two clearcoat layers are illustrated; however, a greater or lesser number of clearcoat layers may be provided. The clearcoat layers may be applied in any suitable manner, such as by spraying with a robotic manipulator.

A first clearcoat layer 70 may be applied to and may be disposed directly on a surface of an underlying layer, such as the surface 56 of the second basecoat layer 54. As such, the first clearcoat layer 70 may have a surface 72 disposed opposite the surface 56 of the first clearcoat layer 70. Similarly, a second clearcoat layer 74 may be applied to and may be disposed directly on the surface 72 of the first clearcoat layer 70. The first and second clearcoat layers 70, 74 may each be semitransparent or transparent such that a color pigment of an underlying layer, such as the color pigment 44 of the color-keyed primer layer 40 and any color pigment in a basecoat layer 50, 54 may be visible or reflect light through the clearcoat layers 70, 74 as described above.

Figure 2:
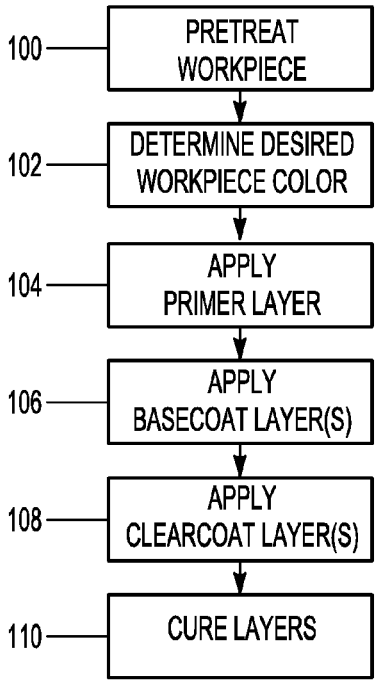
FIG. 2 is a flowchart of an exemplary method of coating a workpiece.

Referring to FIG. 2, an exemplary flowchart of a method of coating or painting a workpiece is shown. The method may be executed in a sequence of steps as shown on the flowchart. In some cases, one or more steps may be performed in a different sequence and may be repeated for different workpieces.

At 100, the workpiece may be pretreated. Pretreating may include cleaning the workpiece substrate 20 to remove contaminates, such as oil and particulates, that may interfere with or inhibit application and bonding of a coating to the substrate 20. In addition, pretreating may include application of the corrosion resistant layer 30 to the substrate 20, application of a pretreat primer layer 34 to the corrosion resistant layer 30, and curing and/or drying of the corrosion resistant layer 30 and pretreat primer layer 34. Curing may be facilitated by baking the workpiece 10 in a manner known to those skilled in the art.

At 102, a desired color for the workpiece is determined. Optionally, this step could occur before or simultaneously with the pretreating step at block 100. In the context of an automobile assembly operation, vehicle body assemblies may be processed through a paint shop in a predetermined sequence in which sequential vehicle body assemblies may or may not be designated to have the same desired color. A desired color may be associated with a predetermined combination of color-keyed primer, basecoat, and possibly clearcoat formulations. Such combinations may be provided as inputs to a control system that controls the coating or painting process such that the correct combination of coatings is applied to the workpiece. For example, color-keyed primer, basecoat, and clearcoat combinations may be predetermined and stored in memory, such as with a lookup table, or provided to the control system. Each desired color may be unique and may be associated with a different combination of color-keyed primer, basecoat, and clearcoat formulations.

At 104, the color-keyed primer layer is applied. The color-keyed primer layer may be applied to the outermost or exposed layer of the workpiece after completion of the pretreating step. For instance, the color-keyed primer layer 40 may be applied to the pretreat primer layer 34 and may conceal or inhibit light from passing through the color-keyed primer layer 40 to the pretreat primer layer 34. As such, the pretreat primer layer 34 may not reflect light and may not contribute to the color of the workpiece 10.

At 106, one or more basecoat layers may be applied over the color-keyed primer layer. A basecoat layer may be applied to the color-keyed primer layer while the color-keyed primer layer is still wet or has not fully cured. Similarly, any additional basecoat layers may be applied to a preceding basecoat layer while the preceding basecoat layer is still wet or has not fully cured. As such, layers may be applied without an intervening baking step, thereby reducing process time and capital investment as well as improving quality by reducing the opportunity for contamination of the workpiece between application of coating layers.

At 108, one or more clearcoat layers may be applied over the color-keyed primer layer and any basecoat layers. Similar to basecoat layer application, a clearcoat layer may be applied to a preceding layer, such as a basecoat layer, while that layer is still wet or has not fully cured. Likewise, any additional clearcoat layers may be applied to a preceding clearcoat layer while the preceding clearcoat layer is still wet or has not fully cured, thereby providing the same benefits as discussed above.

At 110, the layers applied in blocks 104 through 108 may be cured and/or dried, such as by baking the workpiece for a predetermined time and temperature. After curing and/or drying, the coating process may be complete and the color-keyed primer layer may be visible or contribute to the final visible color of the workpiece as previously discussed.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of coating a vehicle body, comprising:

applying a corrosion-resistant layer to the vehicle body;

applying a first primer layer to the corrosion-resistant layer;

applying a color-keyed primer layer having a color pigment to the first primer layer;

applying a first basecoat layer upon the color-keyed primer layer before the color-keyed primer layer is cured;

applying a first clearcoat layer over the first basecoat layer before the first basecoat layer is cured; and baking the vehicle body to cure the color-keyed primer layer, first basecoat layer, and first clearcoat layer such that the color pigment reflects light through the first basecoat layer and first clearcoat layer after baking;

wherein the first basecoat layer is semitransparent and has a basecoat color pigment that differs from the color pigment of the color-keyed primer layer such that the basecoat color pigment does not appear to be the same as the color pigment of the color-keyed primer layer when viewed and wherein the basecoat color pigment and color pigment of the color-keyed primer layer cooperate to provide a visible color of the workpiece and wherein the corrosion-resistant layer, first primer layer, color-keyed primer layer, first basecoat layer, and first clearcoat layer all have the same thickness.

2. The method of claim 1 wherein the step of applying the color-keyed primer layer is preceded by baking the vehicle body to cure the first primer layer;

wherein the color-keyed primer layer is applied to the first primer layer after the first primer layer is cured.

3. The method of claim 2 wherein the first primer layer is not visible through the color-keyed primer layer.

4. The method of claim 1 wherein the step of applying a first basecoat layer further comprises applying a second basecoat layer to the first basecoat layer before the first basecoat layer is cured.

5. The method of claim 4 wherein the second basecoat layer is semitransparent and includes a color pigment that differs from the basecoat color pigment of the first basecoat layer.

6. The method of claim 5 wherein the color pigment of the second basecoat layer differs from the color pigment in the color-keyed primer layer and the basecoat color pigment.

7. The method of claim 6 wherein the first clearcoat layer is more transparent than the first and second basecoat layers.

8. A method of coating a vehicle body comprising:

determining a first desired vehicle body color;

providing a set of color-keyed primers, wherein each member of the set has a different color pigment;

providing a set of first basecoat coatings, wherein each member of the set of first basecoat coatings is at least semi-transparent;

selecting a first member of the set of color-keyed primers and a first member of the set of first basecoat coatings that correspond with the first desired vehicle body color;

applying a corrosion-resistant layer to a first vehicle body;

applying a first primer layer to the corrosion-resistant layer;

applying a color-keyed primer layer to the first primer layer that corresponds to the first member of the set of color-keyed primers;

applying a first basecoat layer to the color-keyed primer layer, wherein the first basecoat layer corresponds to the first member of the set of basecoat coatings, wherein the first basecoat layer is applied to the color-keyed primer layer before the color-keyed primer layer is cured;

applying a first clearcoat layer over the first basecoat layer; and baking the vehicle body to cure the color-keyed primer layer and the first basecoat layer;

wherein the first basecoat layer is semitransparent and has a basecoat color pigment that differs from the color pigment of the color-keyed primer layer and the color pigment of the color-keyed primer layer and the basecoat color pigment contribute to a visible color of the workpiece after baking;

determining a second desired vehicle body color that differs from the first desired vehicle body color;

selecting a second member of the set of color-keyed primers and a member of the set of first basecoat coatings that correspond with the second desired vehicle body color, wherein the second member of the set of color-keyed primers differs from the first member of the set of color-keyed primers;

applying a corrosion-resistant layer to a second vehicle body;

applying a first primer layer to the corrosion-resistant layer of the second vehicle body;

applying a color-keyed primer layer to the first primer layer of the second vehicle body that corresponds to the second member of the set of color-keyed primers;

applying a first basecoat layer that corresponds to the second desired vehicle body color to the color-keyed primer layer of the second vehicle body; and applying a first clearcoat layer over the first basecoat layer of the second vehicle body;

wherein the color pigment of the color-keyed primer layer is visible through the first basecoat layer such that the second vehicle body has a different color than the first vehicle body;

wherein the corrosion-resistant layer, first primer layer, color-keyed primer layer, first basecoat layer, and first clearcoat layer all have the same thickness.

9. The method of claim 8 wherein each member of the set of first basecoat coatings has a different color pigment.

10. The method of claim 8 wherein the first clearcoat layer is applied over the first basecoat layer before the first basecoat layer is cured.

11. The method of claim 8 wherein the color pigment of the color-keyed primer layer is different than a color pigment of each member of the set of first basecoat coatings.

* * * * *